United States Patent [19]

Kooistra, Sr.

[11] 4,301,613

[45] Nov. 24, 1981

[54] MARBLE ACTUATED TOY

[76] Inventor: William J. Kooistra, Sr., 9900 Riverview Dr., Kalamazoo, Mich. 49004

[21] Appl. No.: 170,951

[22] Filed: Jul. 21, 1980

[51] Int. Cl.[3] ..... A63H 29/08

[52] U.S. Cl. ..... 46/42; 46/43

[58] Field of Search ..... 46/41, 42, 44

[56] References Cited

U.S. PATENT DOCUMENTS

| | | | |
|---|---|---|---|
| 2,785,504 | 3/1957 | Kooistra, Sr. | 46/42 |
| 3,030,731 | 4/1962 | Marchus et al. | 46/41 |
| 3,253,354 | 5/1966 | Gollner et al. | 46/42 |
| 3,987,307 | 10/1976 | Giconi | 46/41 |

*Primary Examiner*—Gene Mancene
*Assistant Examiner*—Michael J. Foycik
*Attorney, Agent, or Firm*—Austin A. Webb

[57] ABSTRACT

A main wheel rotating in a vertical plane has marble receiving notches in opposite sides of its periphery. Uprights on opposite sides of the wheel support the wheel shaft and a transfer tray with reverse inclines over the wheel. A smaller drive wheel connected to the shaft has angularly spaced lift pins around a half of its periphery. The pins engage notches in the side of a vertically reciprocable lift bar having an elevator plate on its top. The lift bar is guided along the edge of one upright between a raised position in which the elevator plate transfers marbles to the upper edge of the incline, and a lower position in which the elevator plate is located alongside of the main wheel and radially inwardly from the peripheral notches therein. An intermediate transfer shelf is fixedly supported by the one upright to receive marbles discharged from one of the peripheral notches in the main wheel. A marble release gate is pivoted across the lower end of the incline in the first transfer tray; and a gate raising lever pivoted on the other upright has an actuating end or trip portion supported in the path of two trip pins projecting from the side of the main wheel and associated one with each of the peripheral notches in the wheel. The first or starting notch in the main wheel has a leading edge that is inclined transversely of the main wheel. Retaining wires spanning the sides of the starting notch are connected to the sides of the wheel, with two spaced wires on one side forming an arcuate race for a marble with stops projecting radially inwardly of each end of the race.

The second or trailing peripheral notch has marble retaining wires spanning each of its sides and an overhanging lip projecting in trailing relation over the leading end of the notch to prevent a marble in the notch from being released until the second notch has passed the lowermost position of the wheel.

4 Claims, 2 Drawing Figures

MARBLE ACTUATED TOY

RELATED PATENTS

The toy of this invention is an improvement on the similar toy shown in my previous U.S. Pat. No. 2,785,504, now expired, the disclosure of which is hereby incorporated by reference.

OUTLINE OF INVENTION

The toy of the present invention achieves a faster rotation of the main wheel, and faster transfer of marbles than my prior toy; and is thereforemore interesting for children to operate; and holds their interest for longer periods of time. The increased speed of operation is achieved by raising the position of the intermediate transfer tray closer to the periphery of the main wheel, and thereby shortening the vertical travel of the elevator. Incident to this change of position, variations in the shape of the first notch in the main wheel and the marble guiding wires associated therewith guide and carry the marble from the notch to a radially outwardly displaced position, as well as an axially off-set position, relative to the main wheel so that the inertia force developed by downward rotation of the marble is increased, as well as being transmitted to the periphery of the wheel as the marble and guide wires start to rise. The marble is carried to the higher transfer platform by the increased speed and centrifugal force on the marble.

The second notch in the periphery of the wheel, which releases a marble at the bottom of each rotation, is also reshaped to retain the entrapped marble through a longer arc of rotation, until its inertia and centrifugal forces are balanced; thus permitting the marble to drop out only when its useful force is spent.

THE DRAWINGS

The drawings, of which there is one sheet, illustrate a practical and preferred form of the invention, and indicated the differences in the structure from the corresponding parts of my prior patent, reference to which is made above.

DETAILED DESCRIPTION

Figures 1, 2:
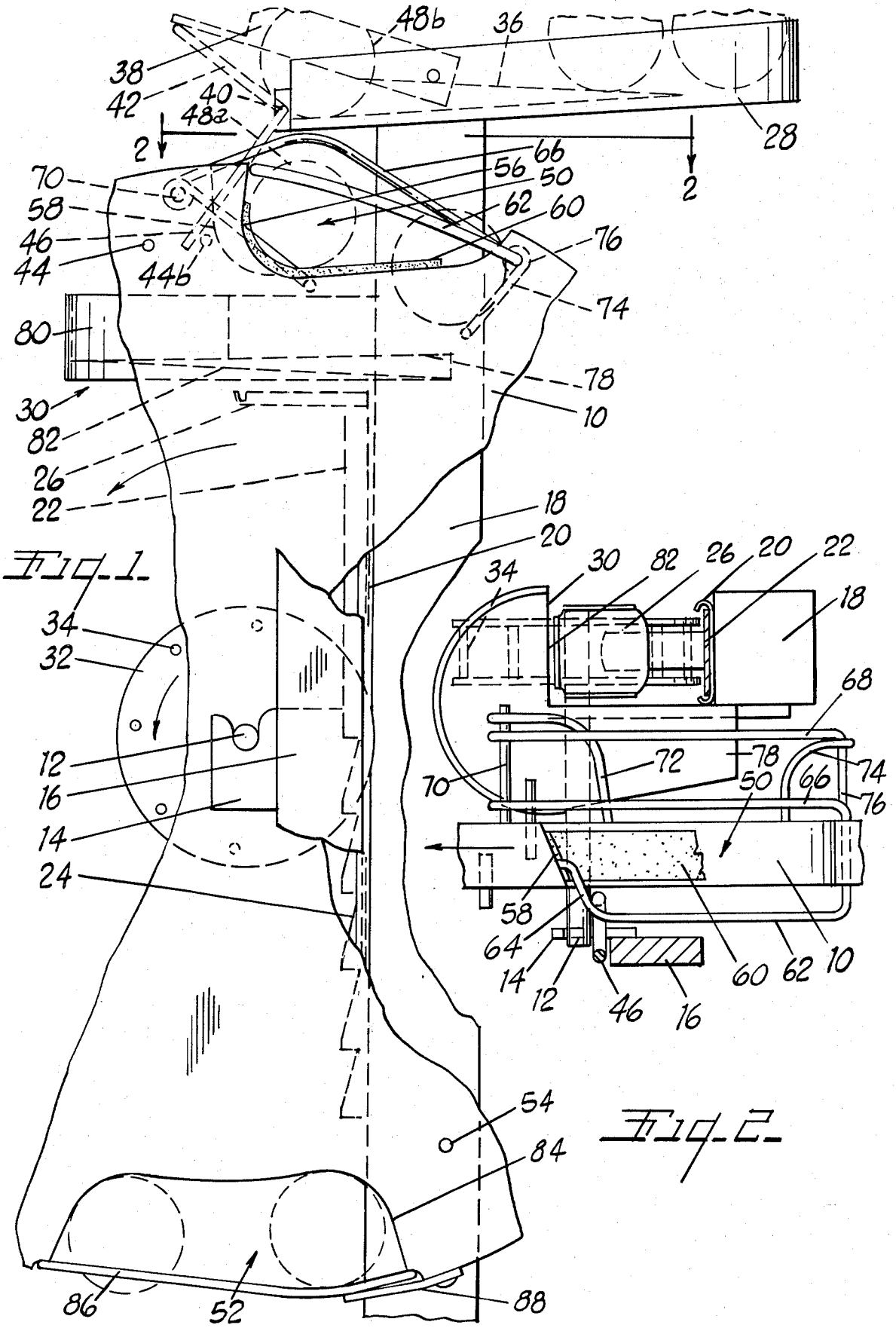
FIG. 1 is a fragmentary elevational view of the toy, with parts broken away to illustrate the new functioning relationship between the new and old parts.
FIG. 2 is a fragmentary horizontal cross sectional view taken along the plane of the line 2—2 in FIG. 1 and looking in the direction of the arrows to illustrate the lower parts in plan view.

The present toy includes the following parts which find corresponding, generally similar parts in my prior toy. A disc 10 having a shaft 12 is rotatably supported by suitable bearing brackets 14 carried on a front column 16 and a rearwardly spaced column 18. The lower ends of the columns are mounted in a base tray (not illustrated) in which the marbles are ultimately collected. The rear column 18 carries a vertical guide channel 20 for an elevator rack 22 having teeth 24 and an elevator platform 26 at its top. The tops of the columns support a loading and delivery tray 28 over the upper periphery of the disc 10. Intermediate of the shaft 12 and periphery of the disc, the rear column 18 supports a transfer shelf 30. Mounted on the shaft 12 is a drive wheel 32 which carries a series of teeth in the form of pins 34 around approximately half of its periphery which mesh with and drive the teeth 24 to raise the platform 26 from receiving position opposite the intermediate transfer shelf 30 to the receiving incline 36 of the delivery tray 28. A gate 38 pivoted on the tray 28 is actuated by a crank pivoted at 40 at the discharge end of the tray. In FIG. 1, the gate is shown in dotted lines in raised or open position, having been raised by arm 42 of the crank when the trip pin 44 on the side of the disc passed from its dotted position **44*b* to strike arm 46 and permit marble 48*a* to drop from position 48*b* into the peripheral notch 50 in the disc. Rotation of the disc is counter-clockwise or to the left as indicated by the arrows in both figures. An opposite marble receiving notch 52 is formed in angularly trailing relation to notch 50, as will be described in greater detail presently. A second gate trip pin 54 projects from the side of the disc ahead of the notch 52**. All of the foregoing are essentially of the same nature and function as in my prior patent.

Marble receiving notch 50 may be designated as the initial notch as it is in the elevated position shown to start the toy in operation, the tray 28 being filled with marbles. Not only does notch 50 receive the first marble, but it carries it a full 360° around with the disc, and deposits it on the transfer shelf 30. As in my prior toy, energy for raising marble **48*a* from its lowermost rotated position to the transfer shelf is derived from a combination of the inertia force or kinetic energy in the rotating marble and disc, but also from added rotational force supplied by a second marble dropped into notch 52 when it and its trip pin 54 reach the top of the disc. Notch 50 can further be designated as the re-supply notch, and notch 52 as the booster notch. As will be noted presently, notch 52** drops each marble which it receives after somewhat over 180° of rotation.

Turning to the details of the improvements relating to re-supply notch 50, it will be noted that its leading end is curved concavely with respect to the periphery of the disc to a depth substantially equal to the diameter of the marbles, as at 56. It is also bevelled laterally or axially rearwardly of the disc, in a leading or advancing direction as indicated at 58. A thin layer of foam or sponge material 60 cushions marbles as they drop into the notch. A first retaining wire or bar 62 bridges the front side of the notch and prevents marbles from escaping therefrom. The leading curved end 64 of the wire (see FIG. 2) also starts the incoming marble laterally toward the rear of the disc, along the bevelled end 58.

As the first marble descends, its weight rotates the disc 10. The marble is retained against radial or axial escape from the disc by a trough, formed on this instance by a pair of parallel wires 66 and 68. The leading ends of the wires are connected by each being wrapped around a pin 70 driven into the rear side of the disc. The wires bow radially outwardly from the circle of the disc, so that as the disc and marble rotate, the marble may swing out beyond the periphery of the disc and thus develop increased speed and kinetic energy which is later fed back into the disc to keep the disc rotating. A leading end stop is formed by a quarter round of bent wire 72 which has its outer end wrapped around the pin 70, while its inner end is pressed into the side of the disc inwardly of notch 50 and angularly behind or trailing pin 70. A trailing end stop formed by a similar quarter round of bent wire 74 has its outer end wrapped around a pin 76 while its inner end extends generally radially inwardly and laterally forwardly to the side of the disc. As the first marble completes its rotation with the disc and the trough forming wires 66 and 68, it loses all its energy and rolls back along the wires 66 and 68 to abut against the trailing stop wire 74. At this time the marble is entirely out of notch 50 and alongside of the disc. As the trailing stop 74 approaches the vertical, the marble falls by gravity to the trailing edge 78 of the intermediate transfer shelf 30. The surface is inclined downwardly and to the left in FIG. 1 to butt against a semicircular shield 80 and then back as at 82 to an open edge located just above the downwardly retracted position of the elevator platform 26. Attention is particularly directed to the location of the delivery edge 82 of the intermediate transfer chute 30 and corresponding lower, marble receiving, position of the elevator 26. These are located much higher than in my prior patent, the lower position of the elevator being well over half the radius of the wheel 10 above the shaft 12. The distance is actually above 60% of the radius of the wheel. As previously described, the platform and the rack bar 22 return the marble to the inlet portion of the feed or supply tray 28.

The trailing or booster notch 50 also varies, in both detail and position from the corresponding part of my previous patent. It will be noted that the leading end of the booster notch in my patent trails the leading end of the first notch by some 187° to 190°, while in my present toy the leading end of notch 52 trails the mid-point of the bevelled end 58 of notch 50 by about 165°, or some 20° to 25° less. The trip pin 54 trails the trip pin 44 by a corresponding angle. This means that the disc rotating force generated by a first marble dropped into notch 50 will be reinforced by the introduction of a booster marble in between 20° to 25° less of rotation; and before the disc completes one half of a rotation. The acceleration or increase in rotational energy occurs before notch 50 reaches the bottom of its rotation, and serves to throw the marble in notch 50 radially outwardly into the bowed portions of retaining wires 66 and 68, as previously described.

The notch 52 is somewhat arcuate and its leading end 84 receives the booster marble to about its full diameter. Side retaining wires 86 secured in grooves at the ends of the notch retain the marble laterally, but are spaced far enough apart to let the marble fall vertically from the notch. A flexible plastic tab 88 nailed over the leading end of the notch forms a yieldable pocket to retain the booster marble until its centrifugal force and kinetic energy is largely expended. As a result, the marble in the booster notch does not fall out until it starts to rise on the upwardly rotating side of the disc, at which time the marble rolls back off of the tab 88 and downwardly between the wires so as not to absorb any of the rotational energy in the disc. As with the upper or first notch 50, a cushioning pad 90 of of foam rubber may be secured to the leading end of the notch.

The increase in rotational energy serves two purposes. It increases the speed of rotation; and also provides the energy necessary to lift the marble in the first notch 50 higher than was the case in my prior patent. It will be noted that the low point of travel of the elevator plate indicated at 47 in the prior patent, as shown in FIG. 1, is only slightly above the level of the shaft 31 of the patent. Thus, the elevator must lift every other marble a distance well over the radius of the wheel or disc. This takes time and energy; and it will be noted that the drive pins 43 on the gear 41 of the patent are disposed or extend over roughly 250° of the periphery of the gear in the patent.

Contrasted with the prior structure, the pins 34 of the drive wheel 32 of my present, improved toy extend over only about 180° of the periphery of the wheel. It follows that the improved toy lifts every other marble a lesser required distance during only half a rotation of the wheel and disc. The drag of the gear or wheel thus is reduced by roughly one third that of the prior gear.

Various changes and refinements of details of the improved toy may be made without departing from the spirit of the invention as defined in the following Claims.

What is claimed to be new and what is desired to be secured by Letters Patent is:

1. A marble actuated toy having a main wheel rotatable about a horizontal axis and having an initial marble receiving notch formed in its periphery, followed in angularly spaced trailing relation relative to the rotation of the wheel by a second booster marble receiving notch in the periphery of the wheel, a marble feed chute supported over the periphery of the wheel and having a gate at its lower end, a drive wheel connected in co-axially spaced relation to said main wheel and having interrupted tooth means around a portion only of its periphery, an intermediate marble transfer chute positioned alongside of said main wheel and vertically between the axis of said wheels and the upper periphery of the main wheel, an upright rack bar having an elevator platform on its upper end and teeth drivingly engagable with the tooth means on said drive wheel to lift said platform from adjacent marbel receiving relation with said intermediate chute to delivery relation to said feed chute, and trip pins on the side of said main wheel associated with said notches to open said gate and deliver a marble to each of said notches as each notch moves under said feed chute, said toy being characterized by:

a pair of marble support wires secured in spaced parallel relation to each other and to the side of said main wheel and extending peripherally of said wheel from end to end of said initial marble receiving notch, and stops at each end of said support wires extending axially of said main wheel and radially inwardly relative to said main wheel to engage a marble at each end of said support wires, said support wires being bowed outwardly in their mid-sections beyond the periphery of said main wheel, the leading end of said initial marble receiving notch leading the leading end of said booster notch by substantially less than 180 degrees, the elevation of said intermediate transfer chute and the lowermost position of said elevator being over one half the radius of said main wheel above the axis of the wheels.

2. A toy as defined in claim 1 in which the leading end of the initial notch in said wheel is bevelled laterally outwardly toward the side of the wheel on which said intermediate transfer chute is located.

3. A toy as defined in claim 1 in which there are parallel guide wires on each side of said main wheel and extending across the open sides of said booster notch and spaced apart further than the diameter of marbles to be used in said toy, and a flexible retaining tab secured to the lip of said booster notch and extending in trailing relation therefrom.

4. A toy as defined in claim 1 in which the leading end of said initial notch in said main wheel leads the leading end of said booster notch by between 158° and 165°.

* * * * *